US012601135B2

(12) United States Patent
Sternberg

(10) Patent No.: US 12,601,135 B2
(45) Date of Patent: Apr. 14, 2026

(54) EDGING INTERFACE FOR A GOLF COURSE BUNKER

(71) Applicant: Capillary Concrete, LLC, Wellington, FL (US)

(72) Inventor: Martin Sternberg, Wellington, FL (US)

(73) Assignee: Capillary Concrete, LLC, Wellington, FL (US)

( * ) Notice: Subject to any disclaimer, the term of this patent is extended or adjusted under 35 U.S.C. 154(b) by 203 days.

(21) Appl. No.: 18/417,197

(22) Filed: Jan. 19, 2024

(65) Prior Publication Data

US 2024/0247456 A1 Jul. 25, 2024

Related U.S. Application Data

(60) Provisional application No. 63/439,967, filed on Jan. 19, 2023.

(51) Int. Cl.

| | |
|---|---|
| ***E01C 13/08*** | (2006.01) |
| ***A63B 69/36*** | (2006.01) |
| ***E02D 17/20*** | (2006.01) |

(52) U.S. Cl.

CPC ..... *E02D 17/202* (2013.01); *A63B 69/3691* (2013.01); *E01C 13/08* (2013.01); *E01C 2013/086* (2013.01)

(58) Field of Classification Search

CPC ..... A63B 69/3691; E01C 13/08; E01C 2013/086

See application file for complete search history.

(56) References Cited

U.S. PATENT DOCUMENTS

| | | | | |
|---|---|---|---|---|
| 4,067,757 | A * | 1/1978 | Layman | E01C 13/08 428/17 |
| 6,035,577 | A * | 3/2000 | Motz | A01G 20/20 428/17 |
| 8,062,143 | B1 * | 11/2011 | Meersman | E01C 13/02 473/173 |
| D682,966 | S | 5/2013 | Allen et al. | |
| 8,845,443 | B1 | 9/2014 | Weaver | |

(Continued)

FOREIGN PATENT DOCUMENTS

| | | |
|---|---|---|
| GB | 2479753 | 10/2011 |
| KR | 101650396 | 8/2016 |
| KR | 20160125185 | 10/2016 |

*Primary Examiner* — Benjamin F Fiorello
(74) *Attorney, Agent, or Firm* — ALLEN, DYER, DOPPELT + GILCHRIST, P.A.

(57) ABSTRACT

An edging interface for a golf course bunker includes a strip of backing divided longitudinally into a first portion and a second portion. The strip of backing is also laterally divided into a plurality of adjacent sections by a plurality of cuts, where each adjacent section is joined together at the first portion, and artificial turf is secured to the first portion. The second portion of each section is configured to be anchored between the golf course bunker and a grass edge of the golf course. The edging interface can be rolled up for handling and shipping, and unrolled in place for installation. The artificial turf comprises straight and curly yarn and has a color to match natural turf stacked bunker edges. In addition, the first portion and the second portion longitudinally divide the strip of backing into substantially equal portions.

12 Claims, 6 Drawing Sheets

(56) References Cited

U.S. PATENT DOCUMENTS

| | | | | |
|---|---|---|---|---|
| 10,220,287 | B2 | 3/2019 | Doble et al. | |
| 10,513,829 | B2 | 12/2019 | Jones | |
| 2004/0229007 | A1* | 11/2004 | Motz | D06N 3/0068 428/95 |
| 2005/0238433 | A1* | 10/2005 | Daluise | E01C 13/08 405/36 |
| 2006/0193703 | A1* | 8/2006 | Carlson | E02D 17/205 405/258.1 |
| 2007/0098925 | A1* | 5/2007 | Daluise | E01C 13/08 428/17 |
| 2009/0038214 | A1* | 2/2009 | Rozen | A01G 9/28 47/33 |
| 2009/0208674 | A1* | 8/2009 | Murphy | A01G 20/00 428/17 |
| 2013/0116060 | A1 | 5/2013 | Allen | |
| 2013/0184090 | A1* | 7/2013 | Sternberg | E01C 7/142 106/738 |
| 2014/0041293 | A1* | 2/2014 | Kellogg | A01G 9/28 47/33 |
| 2014/0170339 | A1 | 6/2014 | Ayers et al. | |
| 2015/0308056 | A1* | 10/2015 | Spittle | D06N 7/0071 428/17 |
| 2016/0040367 | A1 | 2/2016 | Allen | |
| 2017/0191230 | A1 | 7/2017 | Doble et al. | |
| 2018/0021654 | A1* | 1/2018 | Doble | A63B 69/3691 473/173 |
| 2019/0169803 | A1* | 6/2019 | Fellars | E01C 13/02 |
| 2020/0230483 | A1 | 7/2020 | Allen | |
| 2021/0277620 | A1 | 9/2021 | Allen | |

* cited by examiner

EDGING INTERFACE FOR A GOLF COURSE BUNKER

CROSS-REFERENCE TO RELATED APPLICATIONS

This application claims the benefit of U.S. provisional application No. 63/439,967 filed Jan. 19, 2023, which is hereby incorporated herein in its entirety by reference.

FIELD OF THE INVENTION

The present invention relates to golf course bunkers and more particularly to an edging interface for a golf bunker.

BACKGROUND

Golf course bunkers are specially prepared areas of sand, which are often a hollow from which turf or soil was removed. The bunkers may include a lip, wall or face at the edge and consist of soil, grass, stacked turf or artificial materials. The sides of the bunkers are often steep and the location between the grass and the bunker is susceptible to crumbling. Thus, the edges of the bunker require constant maintenance, which is expensive.

Accordingly, there is a need to further develop systems for improving golf course bunkers while reducing the maintenance requirements and extending the longevity of the edges of the bunker.

SUMMARY

An edging interface for a golf course bunker is disclosed. The edging interface includes a strip of backing divided longitudinally into a first portion and a second portion. The strip of backing is also laterally divided into a plurality of adjacent sections, where each adjacent section is joined together at the first portion, and artificial turf is secured to the first portion. The second portion of each section is configured to be anchored between the golf course bunker and a grass edge of the golf course.

The first portion and the second portion longitudinally divide the strip of backing into substantially equal portions, and the plurality of sections are defined by a plurality of lateral cuts in the strip of backing that extend from an edge of the second portion of the strip of backing proximate to an edge of the first portion.

In addition, a selected portion of the strip of backing may be divided into the adjacent sections by a void that is triangular shaped or any other suitable shape in order for the edging interface to be arranged in a curvilinear shape while joined together at the first portions. The edging interface can also be rolled up for handling and shipping, and unrolled in place for installation. The artificial turf may include straight and curly yarn, and comprise a color to match natural turf stacked bunker edges.

In another aspect, a golf course bunker system is disclosed. The system includes a porous concrete liner defining a golf course bunker, where the liner has a ledge between a grass edge of the golf course and the golf course bunker. The system also includes an edging interface overlaying the ledge of the porous concrete liner. The edging interface comprises a strip of backing divided longitudinally into a first portion and a second portion, and divided laterally into a plurality of adjacent sections, where each adjacent section is joined together at the first portion. In addition, the system includes artificial turf secured to the first portion, and a porous concrete anchor layer over the second portion to secure the edging interface in place.

In yet another aspect, a method of constructing a golf course bunker is disclosed. The method includes installing a porous concrete liner for a golf course bunker and forming a ledge between a grass edge of the golf course and the golf course bunker. The method also includes placing an edging interface over the ledge of the porous concrete liner. The edging interface comprises a strip of backing divided longitudinally into a first portion and a second portion, and divided laterally into a plurality of adjacent sections, where each adjacent section is joined together at the first portion. In addition, the method includes applying a porous concrete anchor layer over the second portion to secure the edging interface in place.

BRIEF DESCRIPTION OF THE DRAWINGS

The above objects, as well as additional objects, features and advantages of the present invention, will be more fully appreciated by reference to the following illustrative and non-limiting detailed description of embodiments of the present invention, when taken in conjunction with the accompanying drawings, wherein.

DETAILED DESCRIPTION

The present invention will now be described more fully hereinafter with reference to the accompanying drawings, in which preferred embodiments of the invention are shown. This invention may however, be embodied in many different forms and should not be construed as limited to the embodiments set forth herein. Rather, these embodiments are provided so that this disclosure will be thorough and complete, and will fully convey the scope of the invention to those skilled in the art.

Figure 1:
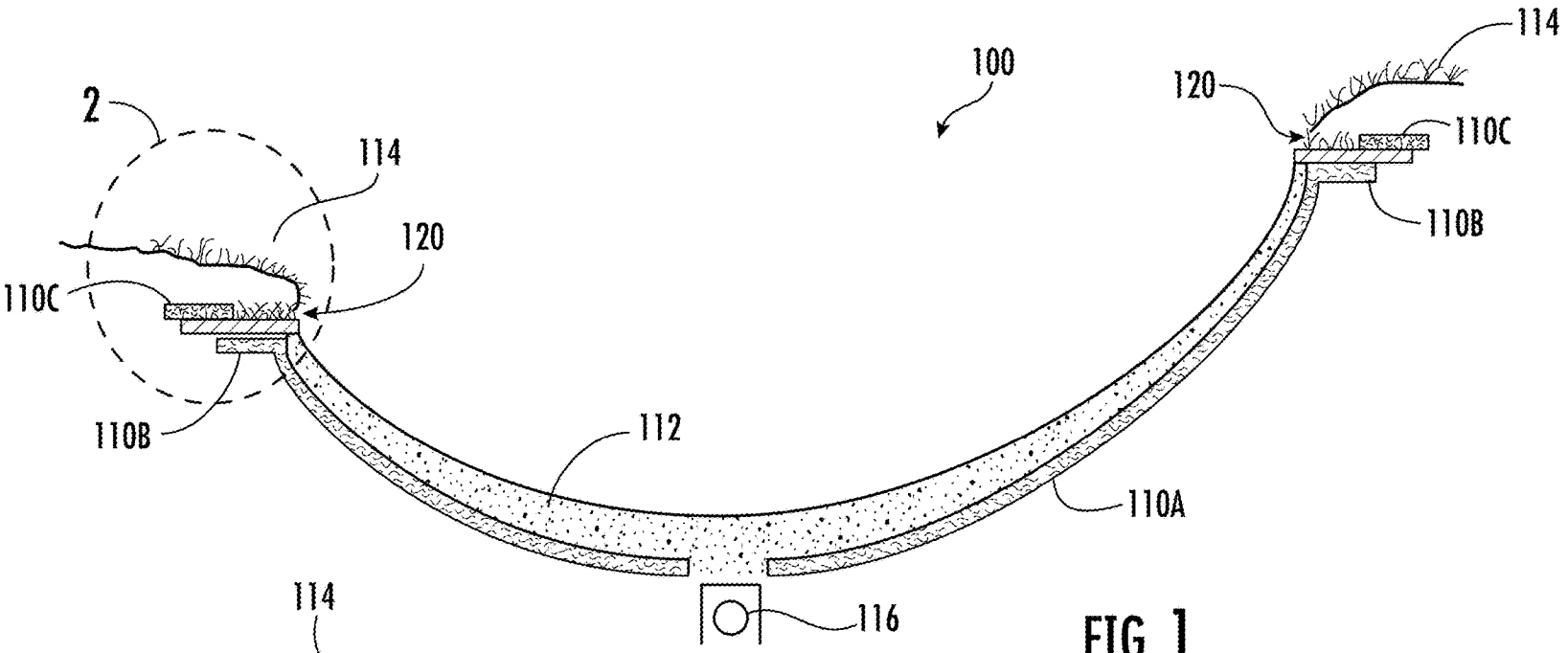
FIG. 1 is a schematic of a cross section of a golf course bunker in accordance with the present disclosure.

Referring now to FIG. 1, a cross sectional view of a typical golf course bunker 100 is shown having the edging interface 120 of the present invention installed. The edging interface 120 includes a strip of backing 122 divided longitudinally into a first portion 128 and a second portion 130. The strip of backing 122 is also laterally divided into a plurality of adjacent sections, where each adjacent section is joined together at the first portion 128, and artificial turf 124 secured to the first portion. The second portion 130 of each section is configured to be anchored between the golf course bunker and a grass edge 114 of the golf course.

The bunker 100 includes a layer of sand 112 over a layer of porous concrete 110A, such as Capillary Concrete® of the Applicant, that forms a liner for the bunker 100. The porous layer 110A terminates in a border that forms a ledge 110B around the bunker 100 and is proximate an interface between the bunker and grass 114 of the golf course. A top layer of porous concrete 110C anchors the edging interface 120 in place and creating a transition from the grass 114 to the bunker sand 112 that requires no maintenance and does not crumble. A drainage pipe 116 is located below the bunker 100 and configured to collect water and prevent ponding within the bunker.

Figure 2:
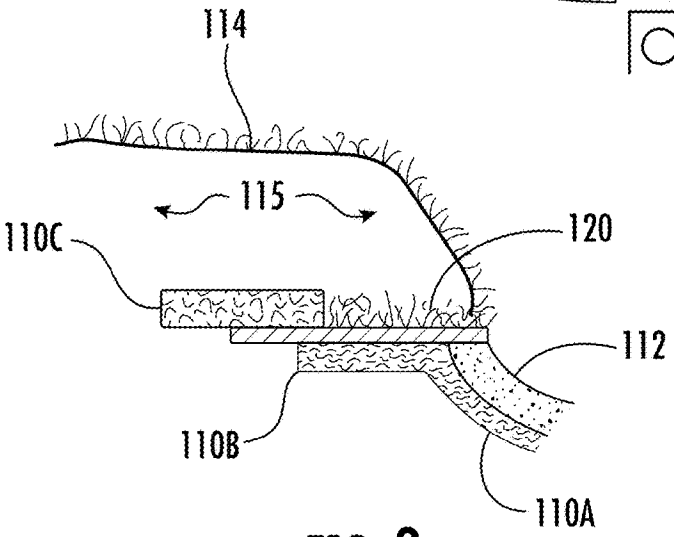
FIG. 2 is a detail cross section of a portion of an edging interface of the present invention.
Figure 3:
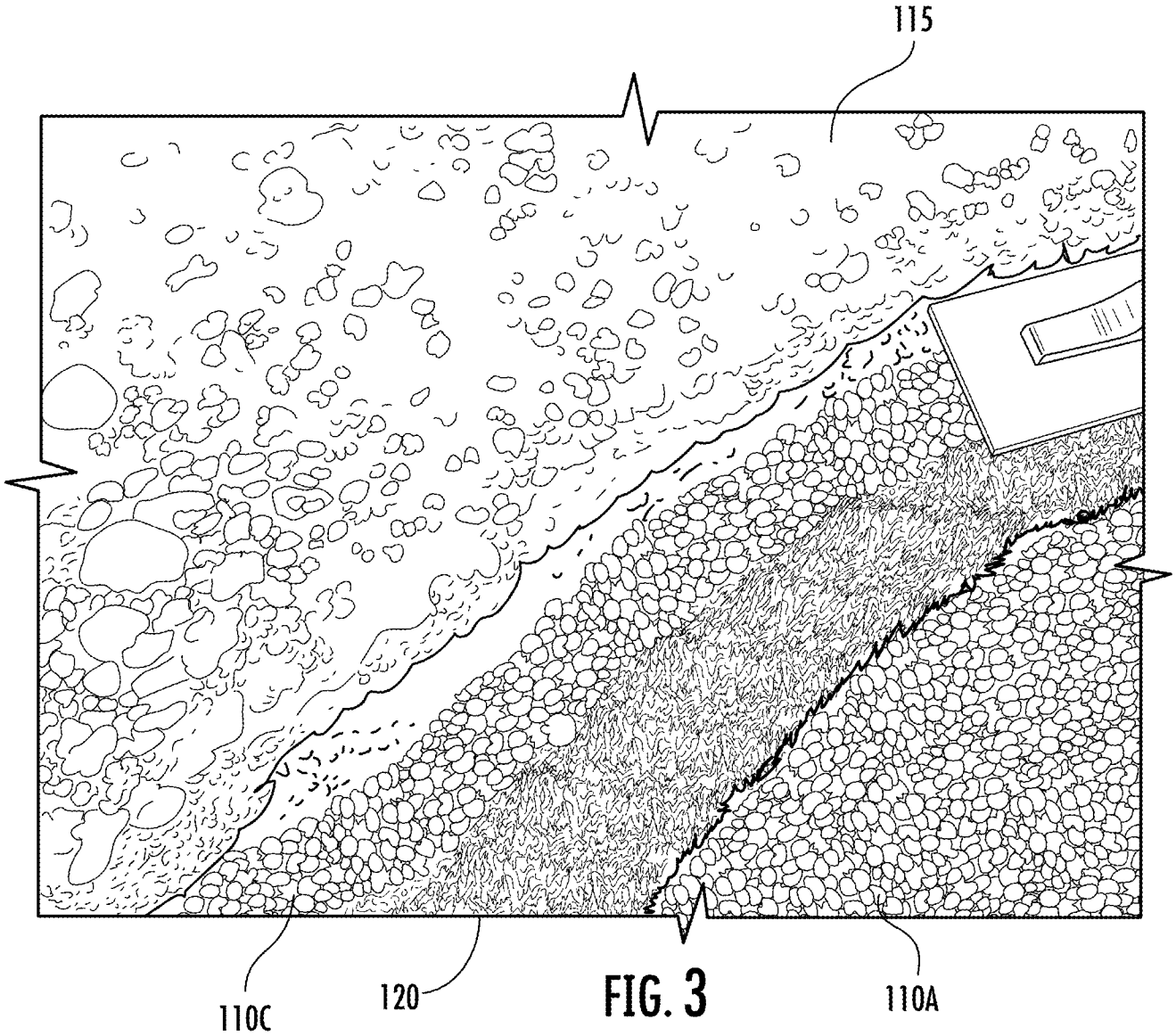
FIG. 3 is a plan view of the edging interface being installed in a golf course bunker.

FIG. 2 is a detail view from the cross-sectional view of FIG. 1. The edging interface 120 is placed on the ledge 110B and the second portion of the edging interface 120 is anchored by the top layer 110C as best shown in FIG. 3. Soil 115 is filled in over the top layer 110C and at least a portion of the edging interface 120. Accordingly, the transition from the grass 114 to the bunker sand 112 is fully supported once the interface edging 120 is installed.

Figure 4:
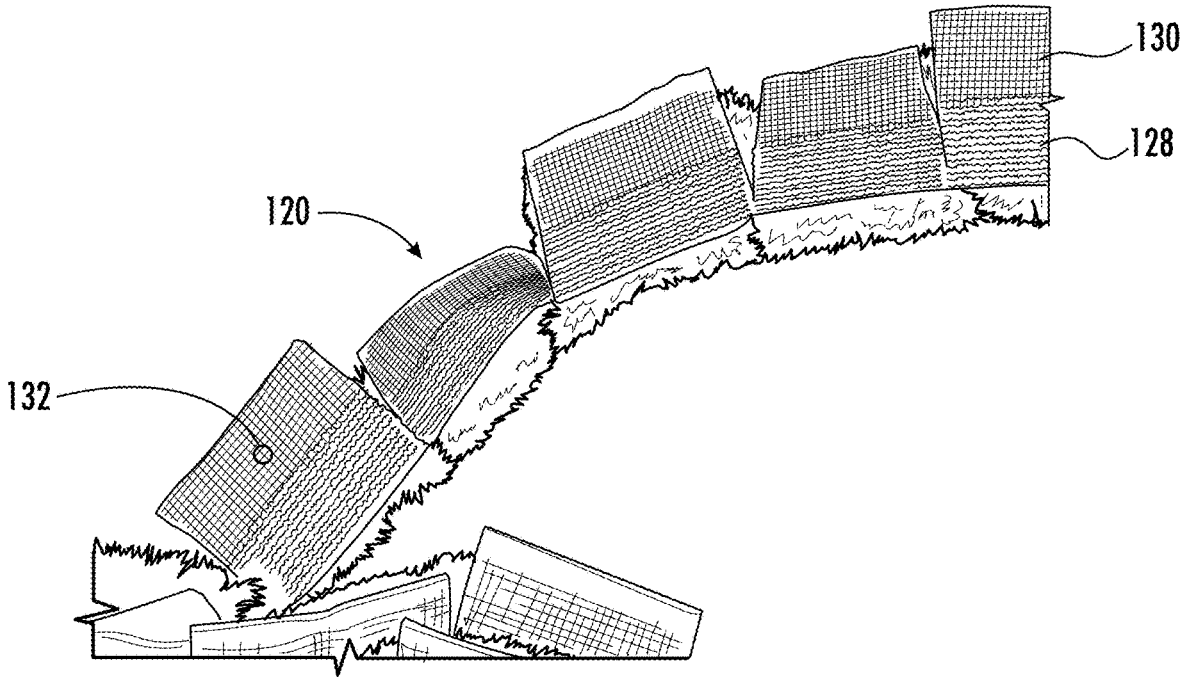
FIG. 4 is a view of a bottom of the edging interface laterally divided into sections.

The bottom surface of the edging interface 120 is shown in FIG. 4. As explained above, the edging interface 120 includes a strip of backing 122 having a first portion 128 and a second portion 130. The strip of backing 122 may comprise nonwoven polypropylene or any suitable material as those of ordinary skill in the art can appreciate. Preferably the backing 122 comprises a non-porous material so that moisture is retained at the interface. This promotes healthy grass at the edge of the bunker.

Figure 5:
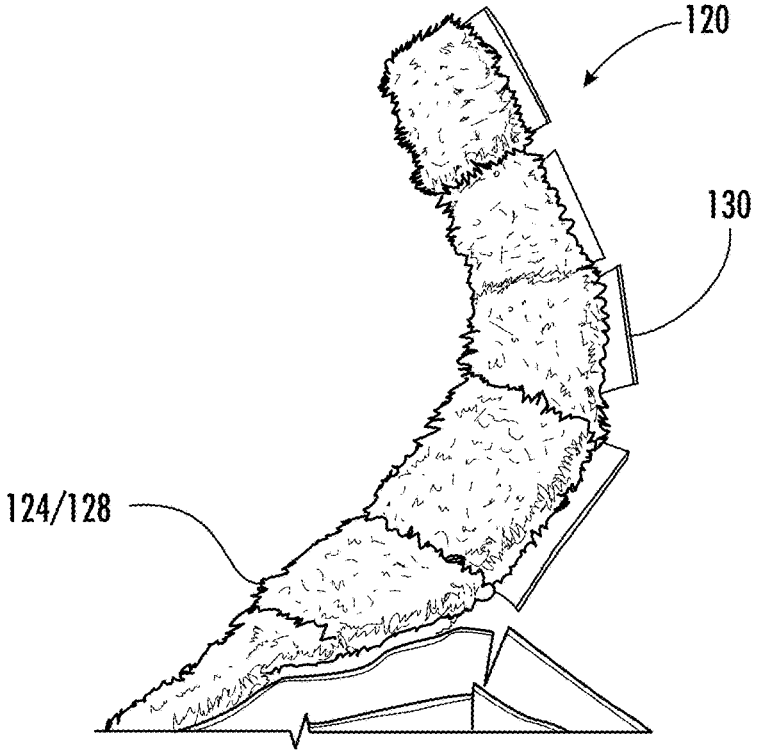
FIG. 5 is a view of a top of the edging interface and artificial turf shown in FIG. 4.

The strip of backing 122 may be laterally divided into a plurality of adjacent sections, where each section is joined at only the first portion 128. This allows the edged interface 120 to be shaped to follow curves of the bunker as shown in FIG. 5. The artificial turf 124 comprises straight and curly yarn, and has a color to match natural turf stacked bunker edges.

Figure 6:
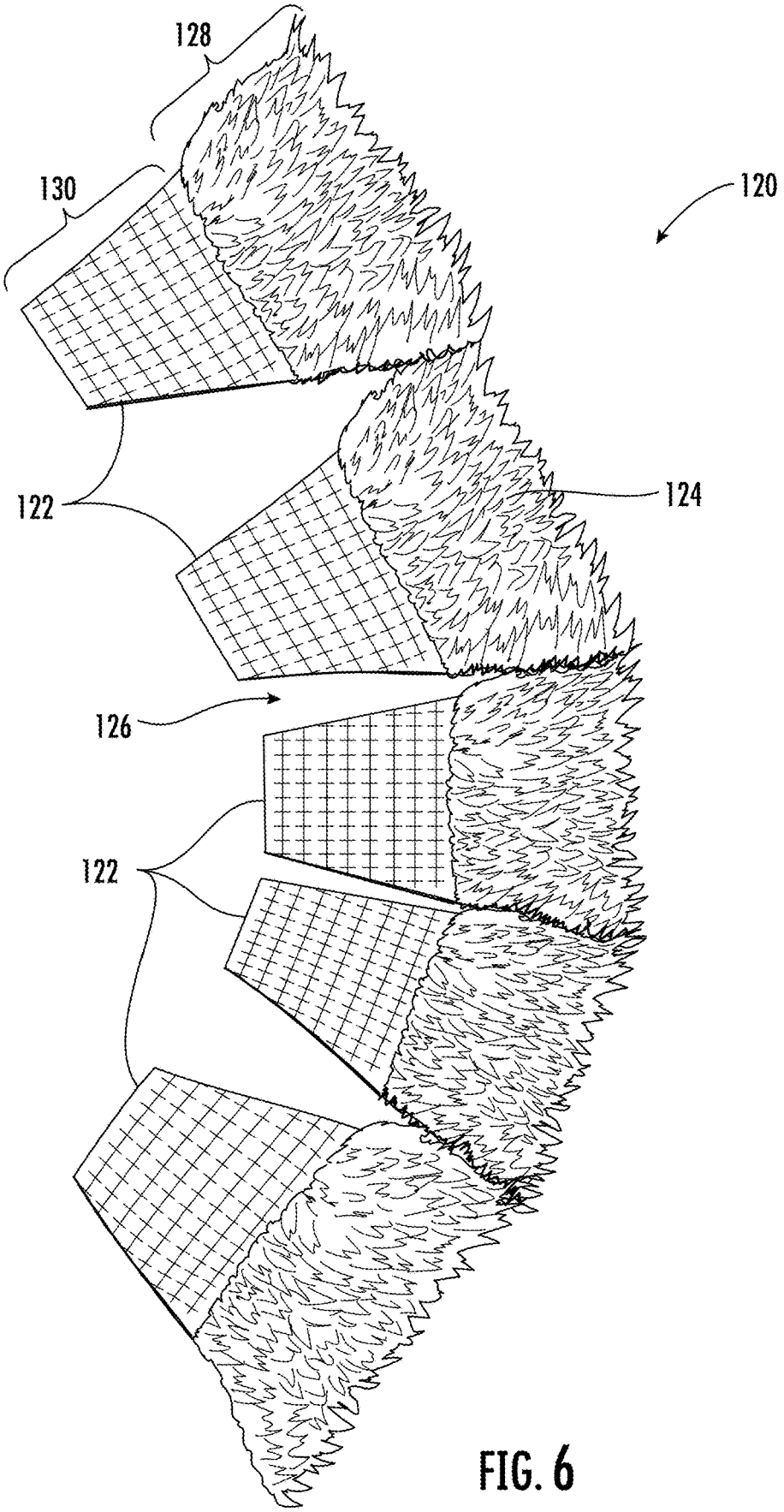
FIG. 6 is the edging interface divided into sections by triangular shaped voids.

The strip of backing 122 may also be divided into the adjacent sections by a cut-out in the backing forming a triangular void 126 as shown in FIG. 6. The adjacent sections are joined together only at the first portion 128 and the second portion 130 of each respective section has a free end that can be positioned to match the curve of the bunker. As explained above, the second portion 130 of the edging interface 120 does not have any artificial turf and instead is configured to be secured by porous concrete between the golf course bunker and the grass edge 114 around the golf course bunker 100.

Figure 7:
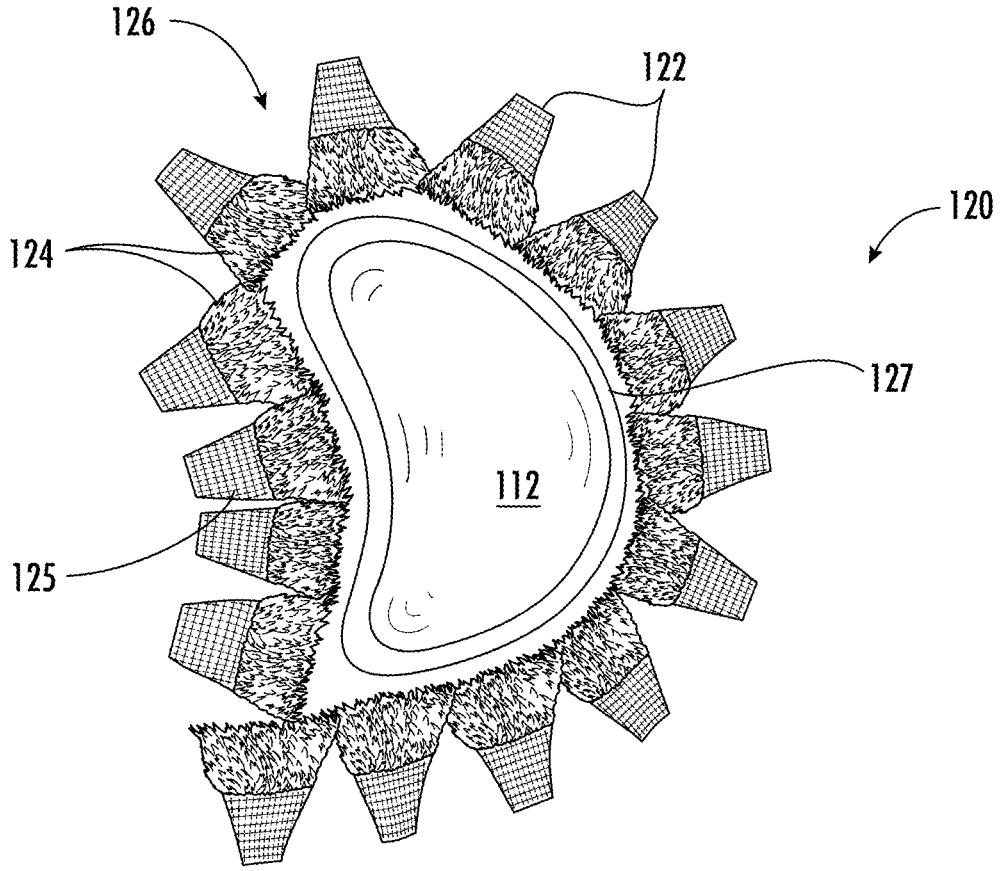
FIG. 7 is a plan view of the edging interface divided by the triangular shaped voids and arranged in a curvilinear shape.
Figure 8:
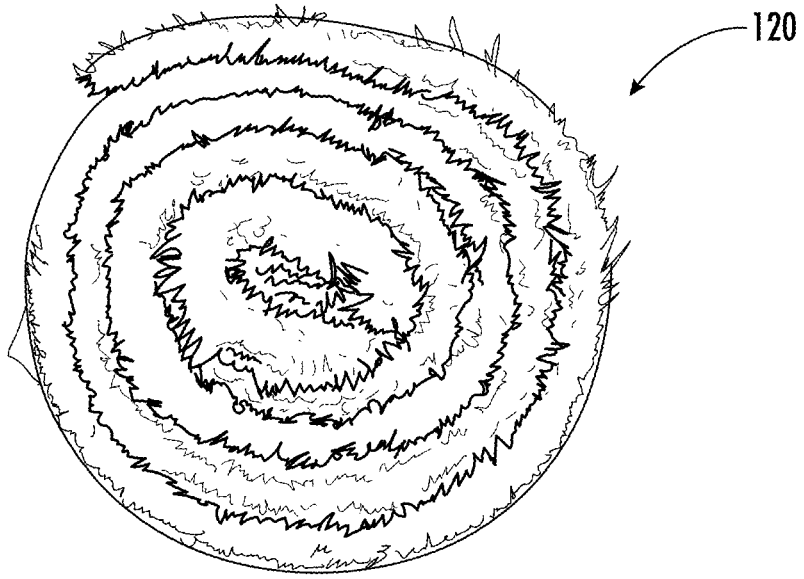
FIG. 8 is an elevational view of the edging interface rolled up for shipping and storage.

In a particular aspect, the edging interface 120 is divided into the adjacent sections by the voids 126 in order for the strip 122 to be arranged in a curvilinear pattern while joined together only at the first portions 128 as shown in FIG. 7. The voids 122 may be triangular shaped or any suitable shape as those of ordinary skill in the art can appreciate. The triangular shaped voids 126 are desirable for inside curves 125 and perpendicular lateral cuts in the edging interface 120 are desirable for straight and outside curves 127.

Figure 9:
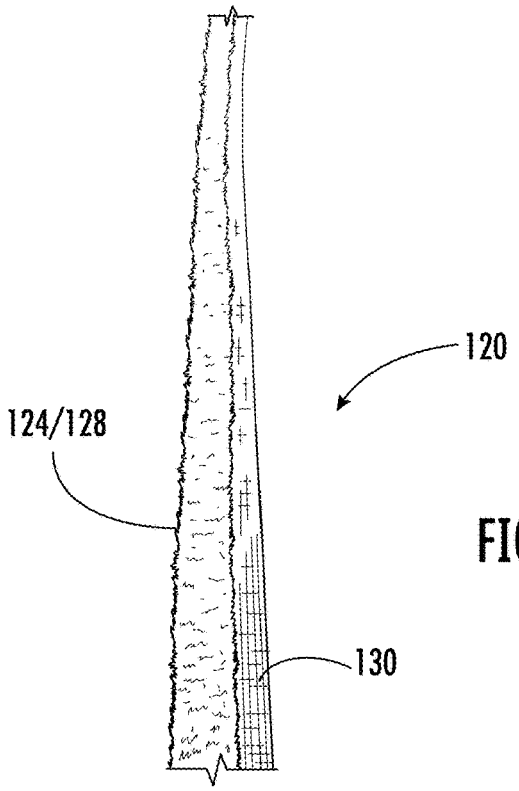
FIG. 9 is a perspective view of a strip of the edging interface in a particular aspect.

The edging interface 120 can be rolled up for shipping and storage as shown in FIG. 9. In addition, installation of the edging interface 120 is more efficient over prior methods that must be stacked like bricks or using parts of natural turf. Instead, the edging interface 120 of the present invention can be placed in position and unrolled saving on time and labor costs. A hole 132 may be in the second portion 130 of the backing and used to help restrain and secure the edging interface 120 by pouring concrete therethrough or using a peg, for example.

Figure 10:
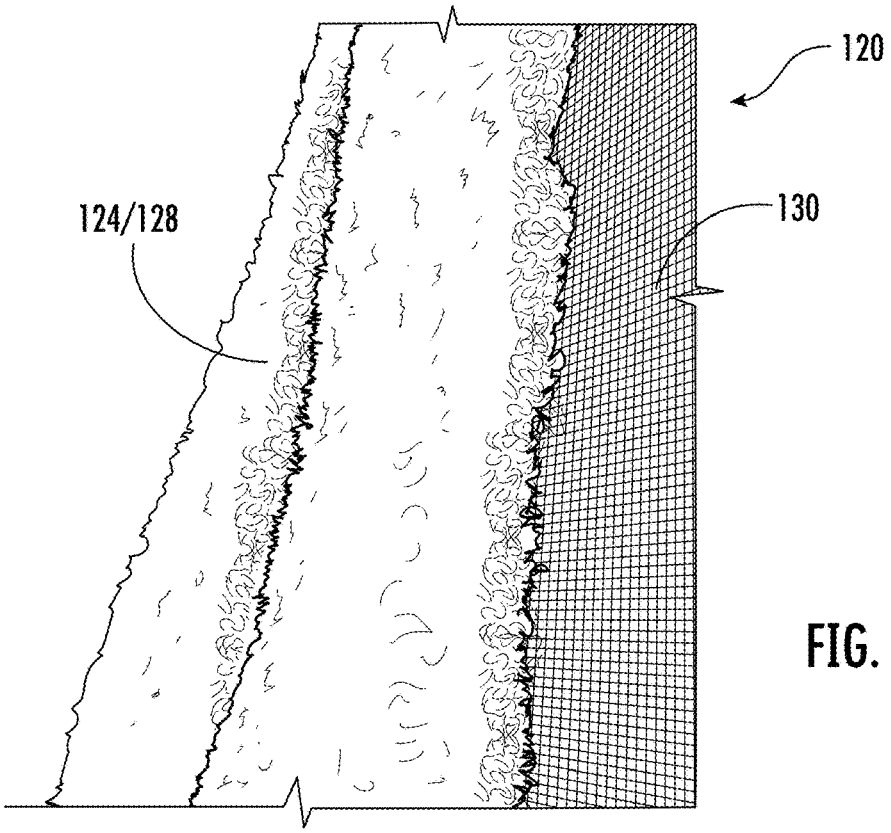
FIG. 10 is a detail rear view of the edging interface.

An enlarged view of the backing 122 and the artificial turf 124 is shown in FIG. 10. In addition, a plurality of layers of the edging interface 120 can be stacked to form a built-up edge between the grass edge and the bunker.

In another aspect a method of constructing an edging interface for a golf course bunker is disclosed. The method includes installing a porous concrete liner 110A for the golf course bunker 100 and forming a ledge 110B between a grass edge 114 of the golf course and the golf course bunker 100. The method also includes placing an edging interface 120 over the ledge 110B of the porous concrete liner, where the edging interface 120 comprises a strip of backing 122 divided longitudinally into a first portion 128 and a second portion 130. The strip of backing 122 is also divided laterally into a plurality of adjacent sections, where each adjacent section is joined together at the first portion 128. The method includes applying a porous concrete anchor layer 110C over the second portion 130 to secure the edging interface 120 in place. The method may also include stacking a plurality of the edging interface 120 to form a built-up edge between the grass edge and the golf course bunker.

Many modifications and other embodiments will come to the mind of one skilled in the art having the benefit of the teachings presented in the foregoing descriptions and the associated drawings. Therefore, it is understood that the disclosure is not to be limited to the specific embodiments disclosed, and that modifications and embodiments are intended to be included within the scope of the appended claims.

That which is claimed is:

1. A golf course bunker system, the system comprising:

a porous concrete liner defining a golf course bunker, wherein the liner has a ledge between a grass edge of the golf course and the golf course bunker;

an edging interface overlaying the ledge of the porous concrete liner, the edging interface comprising a strip of backing divided longitudinally into a first portion and a second portion, and divided laterally into a plurality of adjacent sections, wherein each adjacent section is joined together at the first portion;

artificial turf secured to the first portion; and a porous concrete anchor layer over the second portion to secure the edging interface in place.

2. The system of claim 1, further comprising a plurality of the edging interface stacked to form a built up edge between the grass edge and the golf course bunker.

3. The system of claim 1, wherein the edging interface can be rolled up for handling and shipping, and unrolled in place for installation.

4. The system of claim 1, wherein the artificial turf comprises straight and curly yarn.

5. The system of claim 4, wherein the artificial turf comprises a color to match natural turf stacked bunker edges.

6. The system of claim 1, wherein the first portion and the second portion longitudinally divide the strip of backing into substantially equal portions.

7. The system of claim 1, wherein a selected portion of the strip of backing is divided into the adjacent sections by a void that is triangular shaped or any other suitable shape in order for the edging interface to be arranged in a curvilinear shape while joined together at the first portions.

8. A method of constructing a golf course bunker, the method comprising:

installing a porous concrete liner for a golf course bunker;

forming a ledge between a grass edge of the golf course and the golf course bunker;

placing an edging interface over the ledge of the porous concrete liner, the edging interface comprising a strip of backing divided longitudinally into a first portion and a second portion, and divided laterally into a plurality of adjacent sections, wherein each adjacent section is joined together at the first portion; and applying a porous concrete anchor layer over the second portion to secure the edging interface in place.

9. The method of claim 8, further comprising stacking a plurality of the edging interface to form a built up edge between the grass edge and the golf course bunker.

10. The system of claim 9, wherein the artificial turf comprises a color to match natural turf stacked bunker edges.

11. The method of claim 8, wherein the edging interface can be rolled up for handling and shipping, and unrolled in place for installation.

12. The system of claim 8, wherein the artificial turf comprises straight and curly yarn.

* * * * *